US005926862A

United States Patent [19]

Liu

[11] Patent Number: 5,926,862

[45] Date of Patent: Jul. 27, 1999

[54] TOILET BOWL

[76] Inventor: Richard Liu, Unit 15, 281 Sussex Street, New South Wales, Australia, 2000

[21] Appl. No.: 09/021,368

[22] Filed: Feb. 10, 1998

[51] Int. Cl.[6] ..... E03D 11/00

[52] U.S. Cl. ..... 4/420; 4/311

[58] Field of Search ..... 4/420, 301, 311, 4/300, 237, 234, 421, 431, 434

[56] References Cited

U.S. PATENT DOCUMENTS

| | | | |
|---|---|---|---|
| 266,918 | 10/1882 | Talmadge | 4/311 |
| 602,080 | 4/1898 | Hutchinson | 4/311 |
| 654,601 | 7/1900 | Bunting, Jr. | 4/311 |
| 897,914 | 9/1908 | Madden | 4/311 |
| 3,908,202 | 9/1975 | Sargent et al. . | |
| 3,924,279 | 12/1975 | Morris et al. | 4/420 |
| 4,254,514 | 3/1981 | Sakamoto . | |
| 4,819,277 | 4/1989 | Sikirov . | |

FOREIGN PATENT DOCUMENTS

| | | | |
|---|---|---|---|
| 419745 | 1/1911 | France | 4/420 |
| 761119 | 3/1934 | France . | |
| 2 555 625 | 5/1985 | France . | |
| 29 03 281 | 8/1980 | Germany . | |
| 2 215 748 | 9/1989 | United Kingdom . | |

OTHER PUBLICATIONS

PCT International Search Report of Nov. 21, 1996.

*Primary Examiner*—David J. Walczak

*Attorney, Agent, or Firm*—Venable Baetjer, Howard & Civiletti, LLP

[57] ABSTRACT

A toilet bowl for non-contact use by a person in a crouching position. The toilet bowl includes a back portion; a pair of side walls extending from the back portion and converging towards a truncated front wall. The front and side walls each include an outer surface and an inner lip converging towards an inverted substantially V-shaped rim. The rim in conjunction with the back portion defines the upper opening of the toilet bowl.

8 Claims, 2 Drawing Sheets

TOILET BOWL

TECHNICAL FIELD

The present invention relates to a toilet bowl and more particularly to a toilet bowl adapted for non-contact use by a person in a crouching position.

BACKGROUND ART

Currently, turn around time in public toilets is slow, particularly in women's toilets. Delays are usually attributable to the fact that many women take precautions in an attempt to hygienically use public toilets.

Hitherto, this has involved the use of disposable toilet seat covers or the less desirable practice of covering the toilet seat with toilet paper. The latter method has proved unsuitable for a number of reasons. Firstly, such a toilet paper cover is not an effective barrier to the transmission of many strains of viruses and bacteria. Secondly, the use of excessive quantities of toilet paper is costly and disposal of this toilet paper can cause plumbing problems.

Other attempted methods of hygienic use of public toilets include urinating and/or defecating without coming into contact with the bowl. Research has shown that such usage is generally attempted by adopting a straddling over, or squatting in front of the toilet bowl. However, existing toilet bowl configurations are not suitable for these methods of usage.

Another form of attempted non-contact use involves squatting over the toilet bowl whilst the users feet are placed on the flat rim of the bowl or the hinged toilet seat. This method, in addition to the above disadvantages, is also dangerous as the user may slip from this elevated position.

DISCLOSURE OF THE INVENTION

It is an object of the present invention to provide a toilet bowl which at least in its preferred embodiment, avoids or ameliorates at least some of these disadvantages of the prior art. In particular, it is an object to provide a toilet bowl which is more easily used by a wide proportion of the population in a non-contact crouching position.

According to the invention, them is provided a toilet bowl adapted for non-contact use by a person in a crouching position, the toilet bowl including:

a back portion;

a pair of side walls extending from said back portion and converging towards a corresponding pair of spaced apart corner portions meeting a truncated front wall, said corner portions being part circular in plan view and having spaced apart centers, said front and side walls each including an outer surface and an inner lip converging towards an inverted substantially V-shaped rim; and wherein said rim in conjunction with the back portion defines the upper opening of the toilet bowl.

In this way it will be appreciated that the inverted V-shaped rim defines a larger opening or "target area" to the toilet bowl when compared to a conventional flat rimmed toilet bowl of similar external dimensions. The "target area" is the area of the bowl that will receive urine and/or defecate without any likelihood of spilling and includes any region of the toilet bowl inwardly disposed from the upper most edge of the bowl opening. Accordingly, the inverted substantially V-shaped rim of the invention provides a bigger target area without any increase in external dimensions of the bowl. The truncated front wall also provides a larger target area over existing ovular toilet bowls as the corner portions between the front and side walls are not present in the oval bowl.

Preferably, the back portion includes an inner lip. Preferably also, the back portion inner lip in conjunction with the front and side wall inner lips defines a continuous inner lip around the opening of the toilet bowl. For preference, the back portion is upswept or raised relative to the front and side walls to assist collection of excretia and/or urine.

Desirably, when viewed from the side, the side walls slope downwardly from the back portion to the front wall so as to be substantially parallel to the thighs of the crouching user. This serves to reduce the likelihood of spillage and the like. This sloping also serves to effectively lengthen the opening of the toilet bowl, when compared to horizontal flat rimmed toilet bowls, and thus enlarges the target area.

Desirably also, the outer surface of the front wall sharply rakes away from the front portion of the rim so as to enhance clearance a user's ankles and/or any calf suspended clothing.

In a preferred embodiment, the downwardly sloping rim is slightly concave when viewed from the side so as to more closely approximate the general curved profile of the user's thighs.

According to further aspect, the present invention provides a toilet bowl adapted for non-contact use by a person in a crouching position, the toilet bowl including:

a back portion;

a pair of sidewalls extending from said back portion and converging towards a corresponding pair of spaced apart corner portions meeting a truncated front portion, said corner portions being part circular in plan view and having spaced apart centers, said front portion, corner portions and side walls each including an outer surface and an inner lip converging towards a rim having a non-planer upper surface, the side walls and associated rims, when viewed from the side, sloping downwardly from the back portion to the front portion so as to be, in use, substantially parallel to the thighs of the crouching user and wherein said rim in conjunction with the back portion defines the upper opening of the toilet bowl.

In another preferred embodiment, the back portion contains means to mount the toilet bowl to the wall. In a still further preferred embodiment, the toilet itself is floor mounted.

BRIEF DESCRIPTION OF DRAWINGS

A preferred embodiment of the invention will now be described, by way of example only, with reference to the accompanying in which.

BEST MODE FOR CARRYING OUT THE INVENTION

Figure 2:
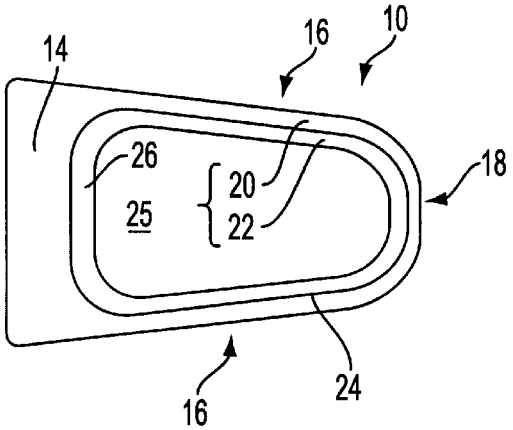
FIG. 2 is a plan view of the toilet bowl shown in FIG. 1.
Figure 3:
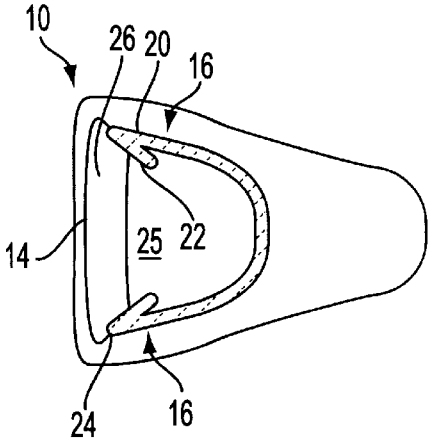
FIG. 3 is a front sectional view of the toilet bowl shown in FIG. 2.
Figure 4:
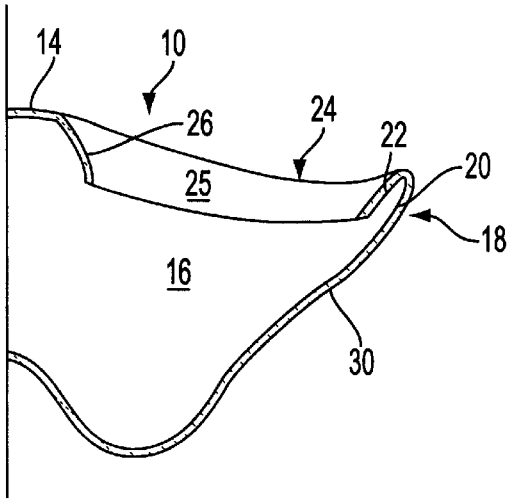
FIG. 4 is a sectional side view of the toilet bowl shown in FIG. 2.

Referring to the drawings, in particular FIG. 2 to 4, there is shown a toilet bowl 10 adapted for non-contact use by a person 12 in a crouching position. The toilet bowl includes a back portion 14 and a pair of side walls 16 extending from the back portion and converging towards a truncated front wall 18. The front and side walls each include an outer surface 20 and an inner lip 22 converging towards an inverted substantially V-shaped rim 24, as best shown in section in FIG. 3. The rim 24 in conjunction with the back portion 14 defines the boundary of the upper opening 25 or "target area" of the toilet bowl.

In the preferred embodiment shown, the back portion 14 also includes an inner lip 26. This back portion lip 26 in conjunction with the front and side wall inner lips 22 form a continuous inner lip around the boundary of the opening 25. This continuous inner lip allows the toilet bowl to be flushed in the usual manner. In other embodiments this lip may be altered to allow the toilet bowl according to the invention to be used with other flushing systems, such as high pressure injectors and the like.

Figure 1:
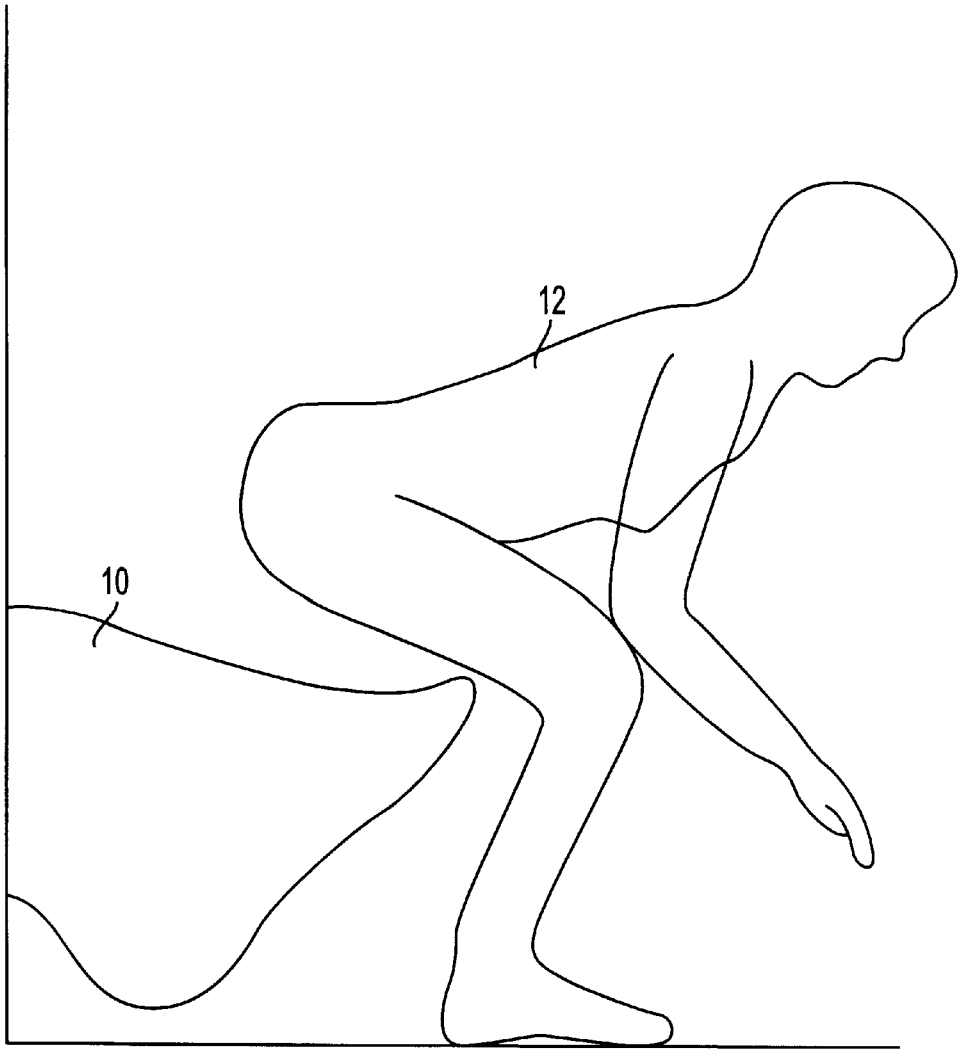
FIG. 1 is a side view of an embodiment of the invention showing a non-contact user in a crouching position.

As best shown in FIG. 4, the side walls 16 slope downwardly from the back portion 14 towards the front wall 18 so as to be substantially parallel to the thighs of the crouching user, as shown in FIG. 1.

The outer surface 30 of the front wall 18 sharply rakes from the front portion of the rim 24 so as to enhance clearance between a user's ankles and/or any calf suspended clothing.

The downwardly sloping side walls are also slightly concave when viewed from the side so as to more closely approximate the profile of the user's thighs.

In an envisaged use, a generally female user adopts a crouching position facing away from the toilet bowl and urinates or defecates into the opening 25. As the shape of the toilet bowl is specifically adapted to be used in this position any spillage of urine or defecate is minimised. In particular, the following features enhance the likelihood of the urine or defecate passing through the "target area" or opening of the toilet bowl:

1. The inverted V-shaped rim defines a larger opening or "target area" to the toilet bowl when compared to a conventional flat rimmed toilet bowl of similar external dimensions. It will be appreciated that the flat rim provided on toilet bowls for sitting is no longer necessary as no sitting takes place.
2. The truncated front wall allows a user to position themselves closer to the toilet bowl than if they were attempting a similar position with a conventional flat rimmed toilet bowl. Again this improves the likelihood of the urine and/or defecate being received within the target area. The provision of the corner portions between the truncated front wall and the side walls also serves to enlarge the target area when compared to an existing oval shaped bowl.
3. The downwardly sloping side rim is specifically configured to more closely approximate the angle of a user's thighs when in the crouched position. This allows the user to adopt a comfortable position whilst ensuring minimum clearance exists between the user's thighs and the rim of the target area. As with the features described above, this also serves to increase the likelihood of urine or defecate entering the target area and reduces the risk of any spillage.

In public toilets existing flat rimmed/sitting toilet bowls have been proven to be impossible, or at least extremely difficult, to use in a hygienic manner.

The present toilet bowl provides significant hygiene advantages over these existing bowls as it is specifically adapted to be able to be used by a broad section of the population without any contact occurring between the user and the toilet bowl thus minimizing the risk of bacterial or viral transmission through the skin or other organs of the body.

The preferred embodiment of the toilet bowl, as shown in the drawings, is also easier to clean and sanitise than existing toilet bowls as it is provided with a continuous and uninterrupted outer surface. In particular the outer has no ledges, niches or fittings which may be prone to germ retention. This feature can be attributed to the fact that as the toilet bowl is adapted for non-contact use it does not require: a toilet seat; lid; or the protruding or recessed connection means, fittings, hinges etc normally associated therewith.

Also, the toilet bowl can find application in male or unisex toilets as it is also suitable for use as a urinal by a male in the standing position or for defecation by a male in the couching position, similar to that previously described with reference to a female.

Further, it is envisaged that some females may be able to use the toilet bow in a crouching position whilst facing towards the bowl. This, however, is not the preferred position for females using the invention.

It would be appreciated to not all segments of the population may find the toilet bowl according to the invention practical to use, in particular the aged and the disabled. In this regard, it is envisaged that the toilet bowl will be used in the private home as well as in conjunction with existing toilet bowls in public multi-cubicle toilets where it will offer the public a useful and desirable alterative to conventional toilets.

To further enhance the usability of the invention hand, elbow or arm rails may be placed in front of and/or to the side of, the bowl to help users support themselves in the non-contact crouching position, if required.

Whilst the invention has been described with reference to a specific example, it will be appreciated by those skilled in the art, that the invention may be embodied in many other forms.

I claim:

1. A toilet bowl adapted for non-contact use by a person in a crouching position, the toilet bowl including:

a back portion;

a pair of sidewalls extending from said back portion and converging towards a corresponding pair of spaced apart corner portions meeting a truncating front wall, said corner portions being part circular in plan view and having spaced apart centers, said front and side walls each including an outer surface and an inner lip converging towards an inverted substantially V-shaped rim; and wherein said rim in conjunction with the back portion defines the upper opening of the toilet bowl.

2. A toilet bowl according to claim 1 wherein the back portion includes an inner lip.

3. A toilet bowl according to claim 2 wherein the back portion inner lip in conjunction with the front and side wall inner lips defines a continuous inner lip around the opening of the toilet bowl.

4. A toilet bowl according to claim 1 wherein the side walls and associated rims, when viewed from the side, slope downwardly from the back portion to the front wall so as to be, in use, substantially parallel to the thighs of the crouching user.

5. A toilet bowl according to claim 4 wherein each downwardly sloping rim is slightly concave when viewed from the side.

6. A toilet bowl according to claim 1 wherein said outer surface of the front wall sharply rakes away from a front portion of said rim.

7. A toilet bowl according to claim 1 wherein the back portion is upswept relative to the front and side walls.

8. A toilet bowl adapted for non-contact use by a person in a crouching position, the toilet bowl including:

a back portion;

a pair of sidewalls extending from said back portion and converging towards a corresponding pair of spaced apart corner portions meeting a truncated front portion, said corner portions being part circular in plan view and having spaced apart centers, said front portion, corner portions and side walls each including an outer surface and an inner lip converging towards a rim having a non-planar upper surface, the side walls and associated rims, when viewed from the side, sloping downwardly from the back portion to the front portion so as to be, in use, substantially parallel to the thighs of the crouching user and wherein said rim in conjunction with the back portion defines the upper opening of the toilet bowl.

* * * * *